US009267510B2

(12) United States Patent
Tadokoro et al.

(10) Patent No.: US 9,267,510 B2
(45) Date of Patent: Feb. 23, 2016

(54) CENTRIFUGAL FAN AND AIR CONDITIONER

(75) Inventors: Takahide Tadokoro, Tokyo (JP); Takashi Ikeda, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 724 days.

(21) Appl. No.: 13/318,363

(22) PCT Filed: Apr. 15, 2010

(86) PCT No.: PCT/JP2010/056736

§ 371 (c)(1),
(2), (4) Date: Nov. 1, 2011

(87) PCT Pub. No.: WO2010/128618

PCT Pub. Date: Nov. 11, 2010

(65) Prior Publication Data

US 2012/0045338 A1 Feb. 23, 2012

(30) Foreign Application Priority Data

May 8, 2009 (JP) ..... 2009-113129

(51) Int. Cl.
*F04D 29/30* (2006.01)
*F04D 29/28* (2006.01)

(52) U.S. Cl.
CPC ..... *F04D 29/281* (2013.01); *F04D 29/30* (2013.01)

(58) Field of Classification Search
CPC ..... F04D 17/16; F04D 29/24; F04D 29/242; F04D 29/245; F04D 29/28; F04D 29/281; F04D 29/282; F04D 29/283; F04D 29/30; F05D 2240/304
USPC ..... 415/206; 416/178, 186 R, 187, 188, 416/194, 195, 228, 232, 243
See application file for complete search history.

(56) References Cited

U.S. PATENT DOCUMENTS 2,083,996 A * 6/1937 Jonn ..... 416/178
5,368,443 A * 11/1994 Turkia et al. ..... 416/184

(Continued)

FOREIGN PATENT DOCUMENTS

EP 942175 A1 * 9/1999
EP 1 574 716 A1 9/2005

(Continued)

OTHER PUBLICATIONS

International Search Report (PCT/ISA/210) in corresponding PCT Application No. PCT/JP2010/056736 dated Jul. 20, 2010.

*Primary Examiner* — Richard Edgar
*Assistant Examiner* — Jesse Prager
(74) *Attorney, Agent, or Firm* — Buchanan Ingersoll & Rooney PC

(57) ABSTRACT

A centrifugal fan includes a main plate that is driven to rotate around a rotational axis, a shroud that is disposed so as to be opposed to the main plate, including an intake port for taking in air, and plural blades that are disposed upright between the main plate and the shroud. An adjacent distance between trailing edges of two adjacent blades is gradually decreased in the direction from the shroud to the main plate, at least from a certain point in the direction from the shroud to the main plate, and further, in each blade, an inclination of a negative pressure surface of the blade that extends from the main plate toward the shroud is smaller at least in the vicinity of the trailing edge than an inclination of a pressure surface of the blade that extends from the main plate toward the shroud.

7 Claims, 14 Drawing Sheets

(56) References Cited

U.S. PATENT DOCUMENTS

| | | | | |
|---|---|---|---|---|
| 5,554,004 | A * | 9/1996 | Stewart | 416/185 |
| 7,771,169 | B2 * | 8/2010 | Kikuchi et al. | 416/178 |
| 8,007,240 | B2 | 8/2011 | Sanagi et al. | |
| 2002/0182079 | A1 * | 12/2002 | Gerken et al. | 416/186 R |
| 2008/0159865 | A1 * | 7/2008 | Lee et al. | 416/179 |

FOREIGN PATENT DOCUMENTS

| | | | |
|---|---|---|---|
| EP | 1 574 716 | B1 | 8/2008 |
| JP | 60-169699 | A | 9/1985 |
| JP | 61-187597 | A | 8/1986 |
| JP | 03-264798 | A | 11/1991 |
| JP | 05-039930 | A | 2/1993 |
| JP | 05-312191 | A | 11/1993 |
| JP | 2000-145690 | A | 5/2000 |
| JP | 2001-132687 | A | 5/2001 |
| JP | 3083869 | U | 11/2001 |
| JP | 2002-021785 | A | 1/2002 |
| JP | 2002-349488 | A | 12/2002 |
| JP | 2005-155510 | A | 6/2005 |
| JP | 2005-282567 | A | 10/2005 |
| JP | 2007-002708 | A | 1/2007 |
| JP | 2007-205269 | A | 8/2007 |
| WO | WO 2007138673 | A1 * | 12/2007 |

* cited by examiner (a-2) ANGLE BETWEEN PRESSURE SURFACE AND MAIN PLATE IS LARGE (b-2) ANGLE BETWEEN NEGATIVE PRESSURE SURFACE AND MAIN PLATE IS LARGE (b)

(a)

CENTRIFUGAL FAN AND AIR CONDITIONER

TECHNICAL FIELD

The present invention relates to a centrifugal fan and an air conditioner using a centrifugal fan.

BACKGROUND ART

FIG. 13 is a configuration diagram of a conventional centrifugal fan 1. The centrifugal fan 1 is comprised of a main plate 2 that rotates, a shroud 3 which is provided so as to be opposed to the main plate 2, and which has an intake port 39 for taking in air, and plural blades 4 which are connected and fixed between the main plate 2 and the shroud 3. Some of the blades 4 may have a hollow structure 5 in the inside for weight saving. When the centrifugal fan 1 rotates in a fan rotational direction 6 shown by an arrow around an rotational axis 17, an airflow 7 is taken in from the shroud side, and the pressure of the airflow 7 is increased while the airflow 7 passing through the blades from a leading edge 41 (also called a blade leading edge part) to a trailing edge 42 (also called a blade trailing edge part), and the airflow 7 is blown outside. Here, a part of the shroud 3 is omitted to make the diagram easy to see.

FIG. 14 is a configuration diagram of a ceiling-embedded type air conditioner using a turbofan 1*a*. (a) of FIG. 14 is a diagram corresponding to a case wherein the turbofan la installed in a ceiling is viewed from below. (b) of FIG. 14 illustrates an X-X cross-section surface in (a) of FIG. 14. Both the turbofan la and a motor 10 that makes the fan rotate are included at a center of the inside of a unit that is made up of a top plate 8 and a side plate 9, and a heat exchanger 11 that exchanges heat with air is arranged in an approximately quadrangular shape so as to surround the turbofan la and the motor 10 in the periphery of the motor 10. A facing plate 12 that faces a room is arranged on a lower side of the unit, an air suction port 13 is placed at a center of the facing plate, and an air blow outlet 14 is placed around the air suction port 13, wherein a vane 15 that controls an airflow direction is installed. Air inside a room is heat exchanged by the heat exchanger after passing through the suction port and the fan, and is blown into a room according to a direction from the blow outlet to the vane, as shown by an arrow 16.

In recent years, efforts to reduce noise and save energy of a blower have been demanded, and there have been many ideas to realize them.

There is a technique to uniform a blow-off velocity distribution by gradually increasing a thickness of a lateral cross-sectional shape of a blade from a shroud side to a main plate side, and narrowing a distance between blades (Patent literature 1).

Further, there is a case example wherein by displacing (shifting) a junction position of a blade between a side plate and a main plate, and guiding a flow on the main plate side to the side plate side, a burble between blades is reduced, a wind velocity distribution is uniformed, and noise reduction is realized (Patent literature 2).

Further, there is an example wherein a blade surface on the main plate side and a shroud side is formed to slant in a rotational direction in order to uniform a wind velocity distribution in a direction of a rotational axis and decrease turbulent noise (Patent literature 3).

CITATION LIST

Patent Literature

Patent literature 1: JP 2001-132687 A
Patent literature 2: JP 5-39930 A
Patent literature 3: JP 2007-205269 A

SUMMARY OF INVENTION

Technical Problem

As for noise in an air conditioner, it is necessary not only to decrease noise of a fan itself, but also to decrease noise that is generated from an air trunk of a unit. A ceiling-embedded type air conditioner includes a heat exchanger comprised of plural fins in a downstream part of a fan, and it is likely to generate noise when high-speed air passes through the heat exchanger immediately after being blown out from the fan. For example, when a direction of a blow-off wind from the fan does not conform with a row direction (the direction of the clearance between the fins) of the heat exchanger, a separation and a vortex occur in the leading edges of the fins, and abnormal noise occurs, and further, ventilation resistance increases. As will be discussed later, in order to reduce these problems, it is necessary to increase a relative velocity between the blades.

Since a centrifugal fan and a turbofan have functions to bend an airflow that is flowing in an axial direction from a shroud side to a radial direction, due to a characteristic that an airflow is likely to be concentrated on a main plate side, it is possible to increase an air velocity between the blades on the main plate side by controlling an air volume by narrowing a space between the blades on the main plate side, as described in Patent literature 1.

However, since there is no difference in the distance between the blades in a trailing edge part, there is a possibility that an airflow cannot be sufficiently accelerated in a blow-off part (especially in the trailing edge part on the main plate side). For example, when looking at FIG. 6 of Patent literature 1, the space between the blades (middle of the main part S) is gradually narrowed toward the main plate from the shroud in the center part of the blades. However, since the thickness in the trailing edge end (22 out part) is almost 0 (zero) (the tip end is narrowed like a needle when seen in the cross-section surface), the distances between the blades do not differ between the main plate and the shroud in the trailing edge part. That is, in a case of Patent literature 1, there is no difference in the distance between the blades in the trailing edge part.

Further, as described in Patent literature 2 and Patent literature 3, by the installation method of the blades, it is possible to reduce noise of the fan itself through uniforming blow-off wind velocity distribution, However, since the wind velocity on the main plate side is decreased, when the fan is mounted on a unit, the blow-off relative velocity with respect to the circumferential velocity of the fan becomes small, and the blowing direction may be inclined toward the swirling direction. As a result, an airflow direction flowing into the heat exchanger is less likely to flow along the row direction of the fins. Therefore, there is a possibility that the flow separates and a vortex occurs in the leading edges of the fins, and abnormal noise occurs.

It is an object of the present invention to provide a centrifugal fan capable of accelerating an airflow also in a trailing edge part on a main plate side.

Solution to Problem

The centrifugal fan according to the present invention includes a main plate that is driven to rotate around a rotational axis, a shroud that is disposed so as to be opposed to the main plate, including an intake port to take in air, and a plurality of blades that are disposed upright between the main plate and the shroud, wherein in two adjacent blades among the plurality of blades, an adjacent distance between trailing edges is gradually decreased in a direction from the shroud to the main plate, at least from a certain point in the direction from the shroud to the main plate, and wherein in each blade of the plurality of blades, an inclination of a negative pressure surface of the each blade which extends from the main plate toward the shroud is smaller at least in a vicinity of a trailing edge than an inclination of a pressure surface of the each blade which extends from the main plate toward the shroud.

Advantageous Effects of Invention

According to the present invention, since a space between the blades on the main plate side is decreased, a relative velocity of an airflow between the blades is increased, and an airflow direction is directed closer to a counter-swirling direction. Therefore, since an absolute velocity vector synthesized by a fan circumferential velocity and the relative velocity is directed in a radial direction of the centrifugal fan, a direction of a blow-off flow conforms with the row direction of the fins of the heat exchanger placed in a downstream part of the fan. In this way, a separation and a vortex do not occur in the leading edges of the fins, abnormal noise does not occur, and ventilation resistance can be decreased.

DESCRIPTION OF EMBODIMENTS

Figure 13:
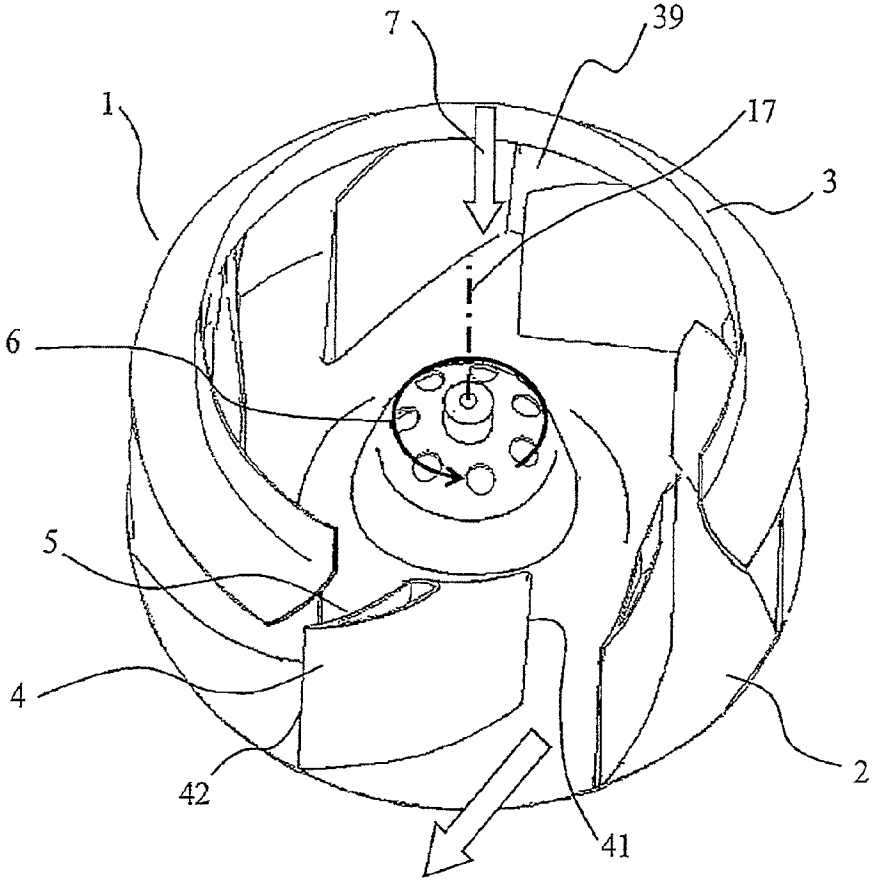
Fig.13 BACKGROUND ART
[FIG. 13] A diagram describing a conventional art.
Figure 14:
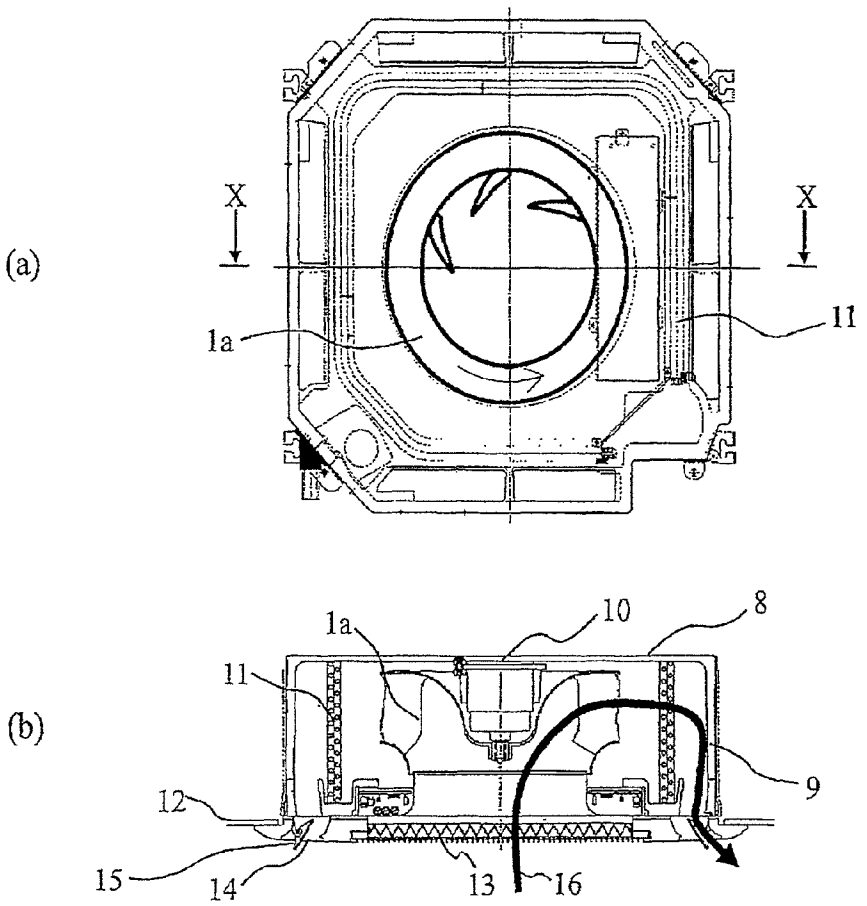
Fig.14 BACKGROUND ART
[FIG. 14] Another diagram describing a conventional art.

Hereinafter, centrifugal fans in the first through seventh embodiments will be described. The centrifugal fans in the embodiments as hereinafter described are characterized by the blades (the structure of the blades, the distance between the trailing edges of adjacent blades, etc.), and the basic configurations except the blades are the same as in the centrifugal fans described in the background arts of FIG. 13 and FIG. 14. Therefore, the parts in common (except the blades) will be described by using the same signs.

Embodiment 1.

Figure 1:
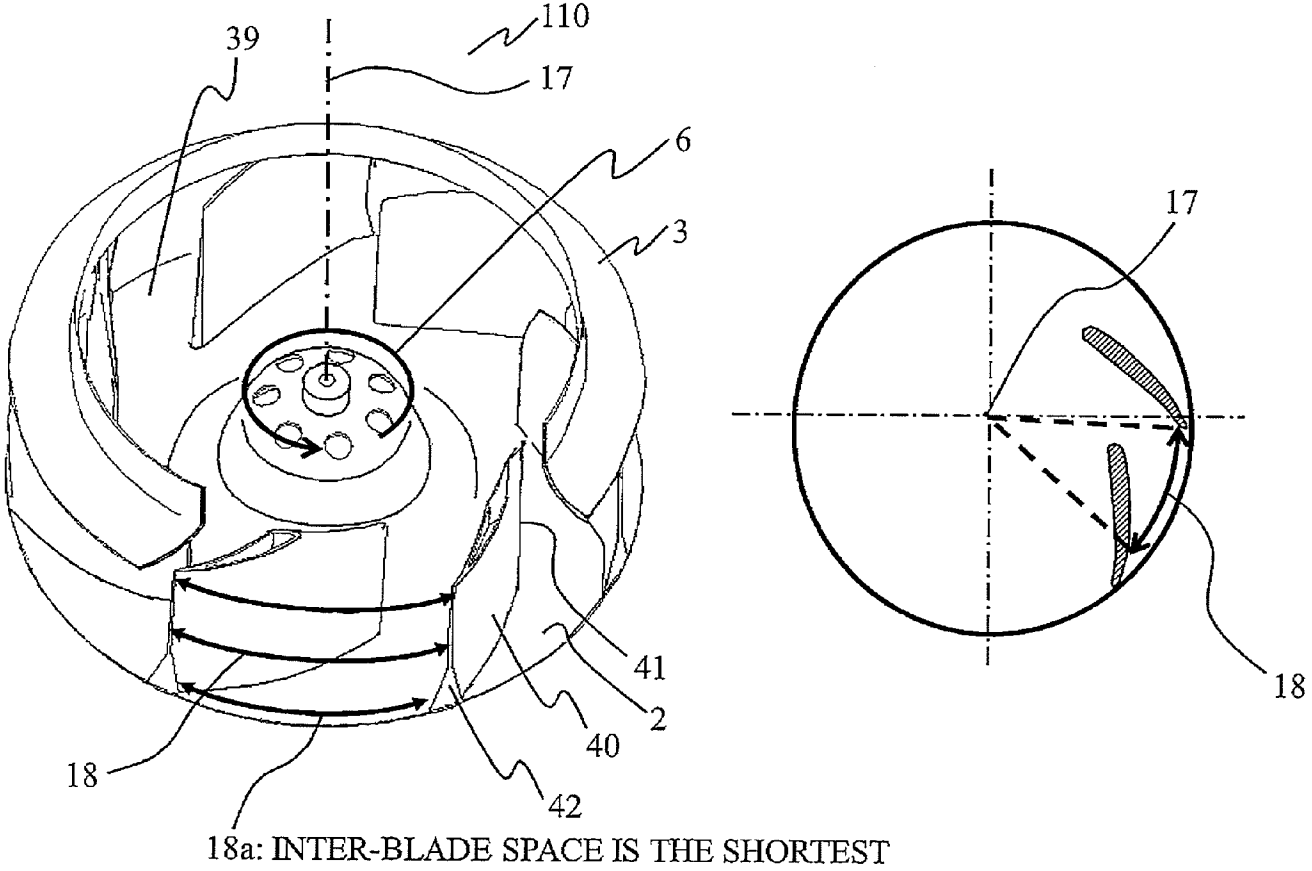
[FIG. 1] A diagram describing a centrifugal fan 110 in the first embodiment.

FIG. 1 is a diagram describing the centrifugal fan 110 in the first embodiment. (a) in FIG. 1 is a perspective view of the centrifugal fan 110. (b) of FIG. 1 is a cross-sectional view of a cross sectional surface formed by cutting through the blade 40 at a certain point by a plane having a normal in a direction of the rotational axis 17, seen from the shroud side.

As shown in (a) in FIG. 1, the centrifugal fan 110 includes the main plate 2 that is driven to rotate around the rotational axis 17, the shroud 3 that is arranged so as to be opposed to the main plate 2, having the intake port 39 for taking in air, and the plural blades 40 that are disposed upright so as to be connected and fixed between the main plate 2 and the shroud 3.

(The First Feature)

The first feature of the centrifugal fan 110 is that, as shown in (a) in FIG. 1 and (b) in FIG. 1, when an arc length 18 connecting surfaces of adjacent blades by an arc around the rotational axis 17 is defined as "inter-blade space," the inter-blade space in the blade trailing edge part 42 is the smallest on the main plate side 18*a* (the smallest inter-blade space). That is, an adjacent distance between the trailing edges of two adjacent blades as shown in (a) in FIG. 1 is gradually decreased in the direction from the shroud 3 to the main plate 2, at least from a certain point in the direction from the shroud 3 to the main plate 2.

(The Second Feature)

Figure 2:
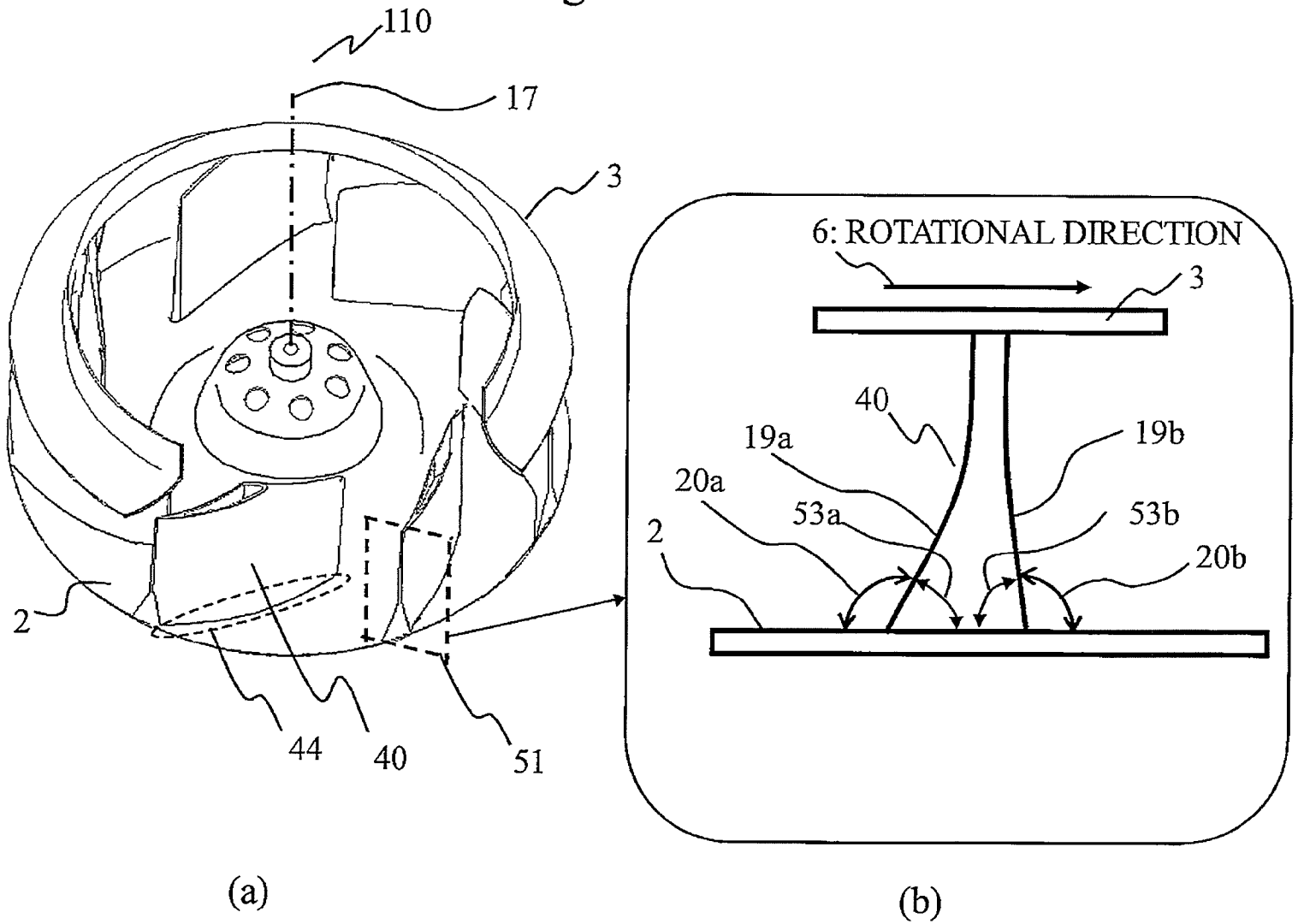
[FIG. 2] A diagram describing a shape of a trailing edge of the centrifugal fan 110 in the first embodiment.

(a) in FIG. 2 is the same perspective view as (a) in FIG. 1. (b) in FIG. 2 is a diagram simplifying and describing a cross sectional surface formed by cutting the trailing edge of the centrifugal fan 110 (the blade 40) by a plane 51 shown by a dashed line in (a) in FIG. 2. A normal of the plane 51 is in an approximately same direction as a direction perpendicular to the rotational axis 17, and as a direction extending from the trailing edge toward the leading edge of the blade 40 (a tangential direction in the vicinity of the trailing edge in a direction from the trailing edge to the leading edge) when the rotational axis 17 is seen from the side of the shroud. Here, the second feature of the centrifugal fan 110 is that, as shown in (b) in FIG. 2, in regard to an angle 20 between the blade surface and the main plate 2, an angle 20*a* on a negative pressure surface side is larger than an angle 20*b* on a pressure surface side at a joint part of the main plate 2 and the blade 40.

That is, angle 20*a* (negative pressure surface)>angle 20*b* (pressure surface).

In other words, as for the blade 40, an extending inclination 53*a* (corresponding to the angle 20*a*) of the negative pressure surface of the blade which extends from the main plate 2 toward the shroud 3 is smaller (more gentle) at least in the vicinity of the trailing edge than an extending inclination 53*b* (corresponding to the angle 20*b*) of the pressure surface of the blade which extends from the main plate 2 toward the shroud 3. In (a) in FIG. 2, an area 44 where the pressure surface extends from the main plate 2 toward the shroud 3 is shown. An area where the negative pressure surface extends from the main plate 2 toward the shroud 3 is not shown, which is on the opposite side of the area 44.

(Operations Related To the First Feature)

Next, operations related to the first feature will be described using FIG. 3 and FIG. 4.

Figure 3:
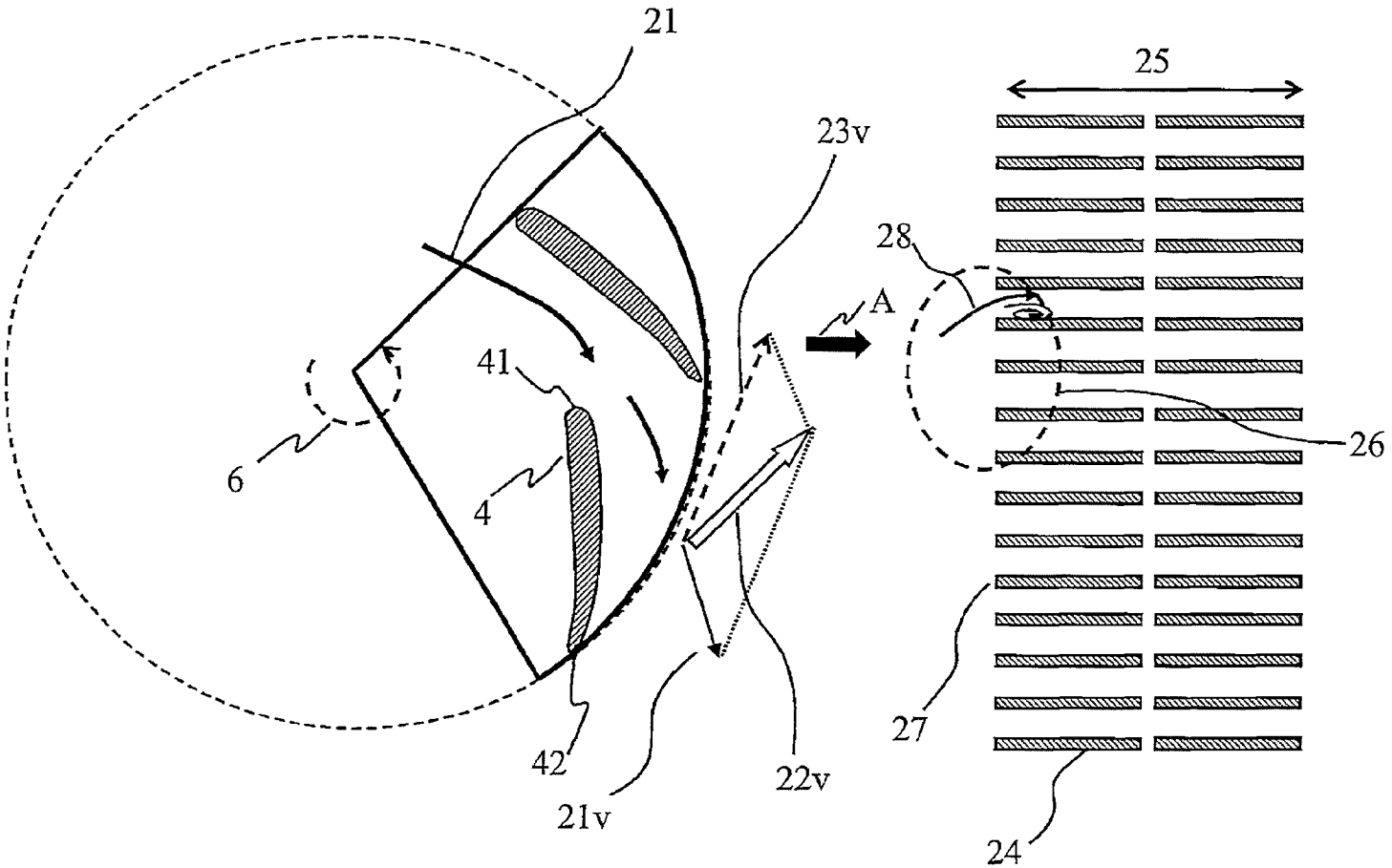
[FIG. 3] A diagram illustrating a flow between blades of a conventional turbofan for describing a feature of the centrifugal fan 110 in the first embodiment.

FIG. 3 is a diagram illustrating a flow between blades of a conventional turbofan. FIG. 3 illustrates a cross sectional surface formed by cutting the blade 4 at a certain point by a plane having a normal in the same direction as the rotational axis 17, seen from the shroud side. An airflow flowing from the leading edge side of the blade 4 passes through the inter-blade space and is blown out to an outer periphery of the fan. Since the inter-blade space is broadened from the inner periphery side to the outer periphery side, a flow 21 (relative velocity) seen from a rotating blade slows down. Since a blow-off flow 22 (absolute velocity) of the fan is expressed by a resultant vector 22*v* of a relative velocity vector 21*v* and a circumferential velocity vector 23*v* of the fan, the blow-off flow of the conventional fan is inclined to be directed in a swirling direction (inclined to be closer to the direction of the circumferential velocity vector 23*v*). A heat exchanger comprised of plural heat-transfer funs 24 (hereinafter indicated as the heat-transfer fins 24) is placed in a downstream part of the fan. The heat-transfer funs 24 are disposed at certain intervals, and the row direction 25 approximately coincides with a radial direction of the fan (direction of an arrow A) in an area 26 where the heat-transfer funs 24 are the closest to the centrifugal fan 110. In a conventional air conditioner, a direction of a blow-off flow is directed in a swirling direction (closer to the direction of a circumferential velocity vector 23*v*), and the direction of the blow-off flow does not conform with the row direction 25 of the heat-transfer fins 24. Because of this, abnormal sound is generated due to occurrence of a separation of a flow and a vortex 28 in the leading edges 27 of the heat-transfer fins 24, which are inflow sections, and further, ventilation resistance is increased. This influence is large on the main plate side since the air volume passing through the inter-blade space is large. Further, there is much influence in the area 26 where the fan and the heat exchanger are the closest to each other, since the wind velocity that is blown out flows into the heat exchanger with keeping its high speed state.

Figure 4:
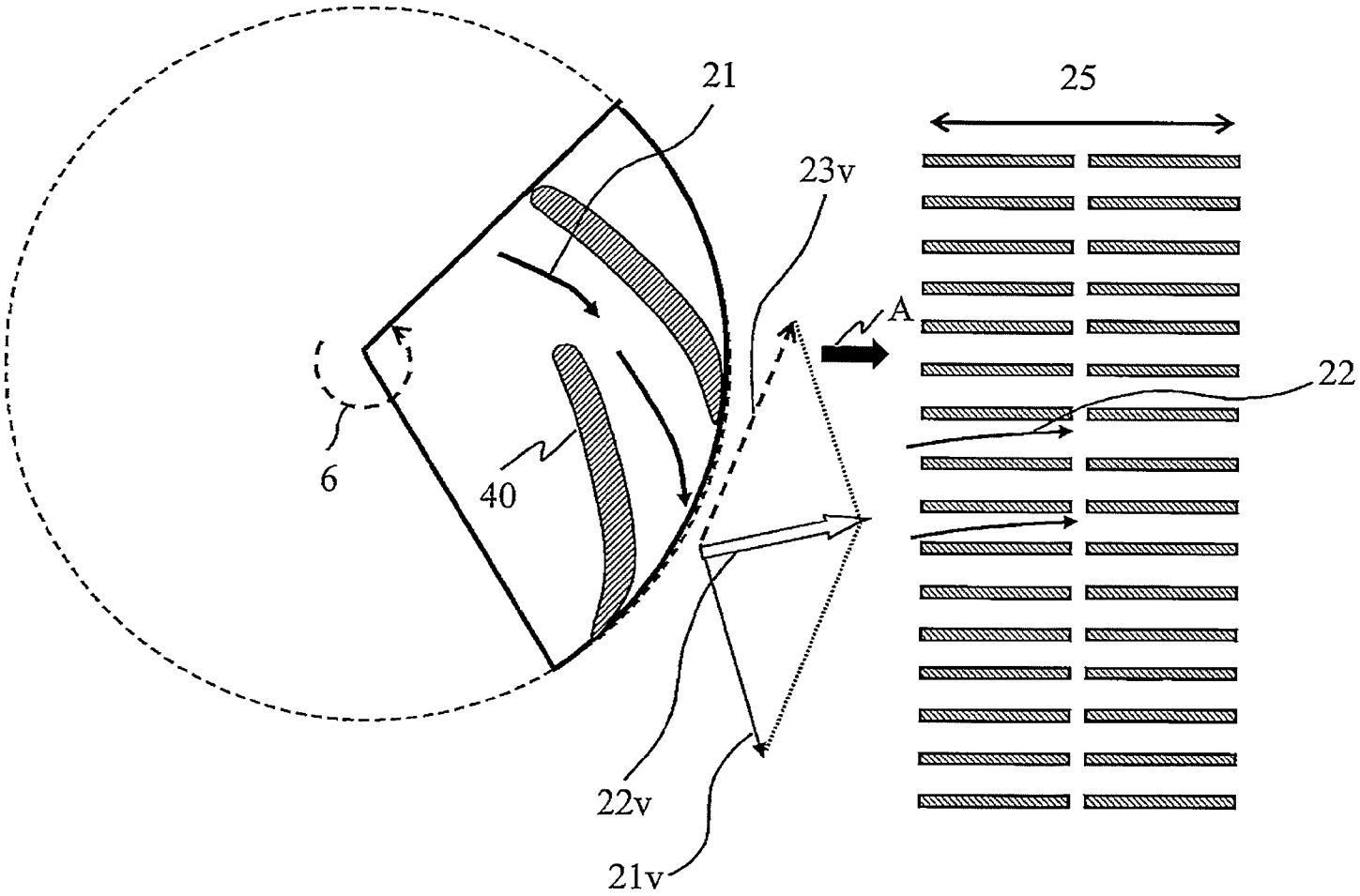
[FIG. 4] A cross-sectional view illustrating a flow between blades in the first embodiment.

FIG. 4 is a cross-sectional diagram of a flow in the inter-blade space of the centrifugal fan 110 shown by the same cross-sectional surface as in FIG. 3. As shown in (a) in FIG. 1, in the centrifugal fan 110, the distance between the trailing edges of the adjacent blades is gradually decreased in the direction of the rotational axis 17 from the shroud 3 toward the main plate 2, at least from the vicinity of the main plate 2, and the distance between the trailing edges is the smallest at a part where the trailing edges reach the main plate 2. Therefore, the relative velocity 21 becomes large on the main plate side, and the blow-off flow 22 derived from the circumferential velocity vector 23*v* and the relative velocity vector 21*v* of the centrifugal fan 110 is inclined to be directed in a radial direction (arrow A direction) compared to the conventional fan.

(Operations Related To the Second Feature)

Next, operations related to the second feature will be described with reference to FIG. 5. First, an effect of making the angle 20*a* on the negative pressure surface side larger than the angle 20*b* on the pressure surface side (angle 20*a*>angle 20*b*) in the angle 20 between the blade surface and the main plate 2 will be compared to the reverse shape (angle 20*a*<angle 20*b*), that is, a case wherein the angle 20*b* between a taper 60*b* and the main plate 2 on a pressure surface 19*b* side is larger.

Figure 5:
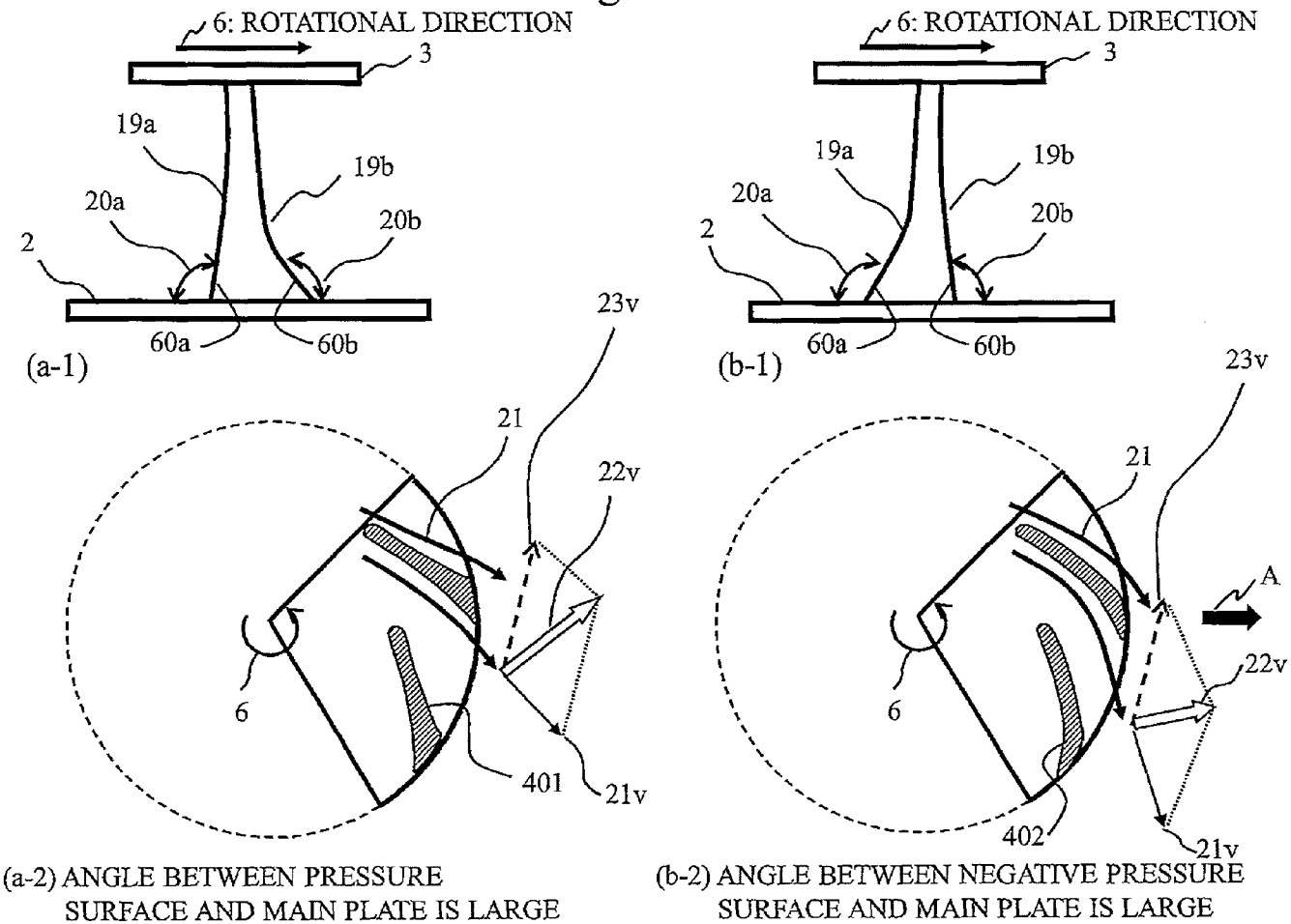
[FIG. 5] A diagram describing the second feature of the centrifugal fan 110 in the first embodiment.

(a-1) in FIGS. 5 and (a-2) in FIG. 5 describe a case of the reverse shape (angle 20*a*<angle 20*b*). (b-1) in FIGS. 5 and (b-2) in FIG. 5 describe the shape of the blade 40 (angle 20*a*>angle 20*b*). (a-1) in FIGS. 5 and (b-1) in FIG. 5 are diagrams showing the trailing edges of the fan by a plane in a direction approximately perpendicular to the blade 40 in the direction along the rotational axis 17. That is, similarly as (b) in FIG. 2, a schematic view of a cross-sectional surface cut by the plane 51. (a-2) in FIGS. 5 and (b-2) in FIG. 5 are diagrams showing flows through the inter-blade space in the vicinity of the main plate seen by a cross-sectional surface perpendicular to the rotational axis 17 (cross-sectional surface having a normal in the same direction as the rotational axis 17).

(In A Case of the Angle 20*a*<the Angle 20*b*)

As in (a-1) in FIG. 5, when the angle 20*b* between the taper 60*b* and the main plate 2 on the side of the pressure surface 19*b* is larger or the same (when an extending inclination of the pressure surface is small), the blade surface in the vicinity of the trailing edge is directed in the rotational direction due to influence of the blade thickness.

(In A Case of the Angle 20*a* >the Angle 20*b*)

Meanwhile, when the angle 20*a* between the taper and the main plate on the negative pressure surface side is made large as in (b-1) in FIG. 5, the negative pressure surface 19*a* in the vicinity of the trailing edge is directed in a counter-swirling direction. The meaning of this will be explained with reference to FIG. 6.

Figure 6:
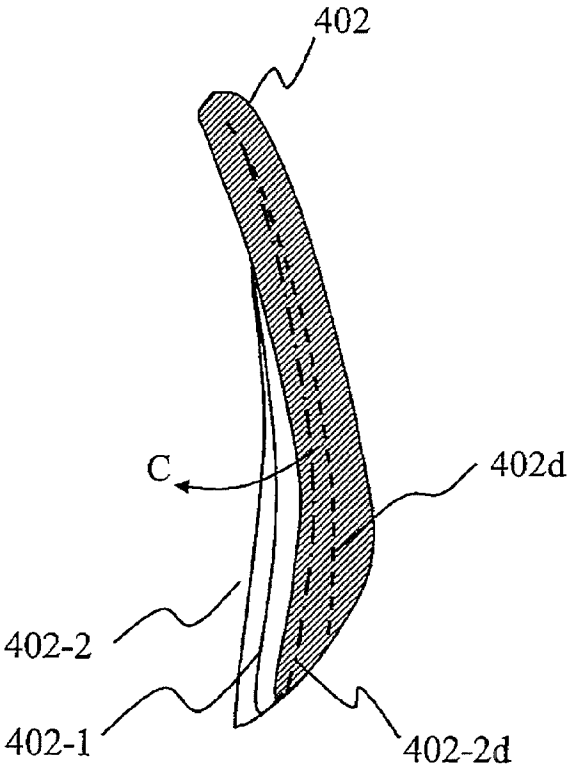
[FIG. 6] Diagrams of a blade cross-section 401 and a blade cross-section 402 that are extracted from FIG. 5.
Figure 6:
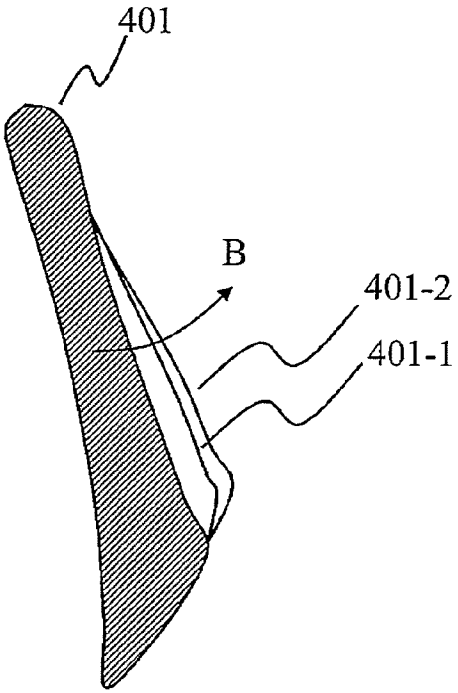

FIG. 6 is a diagram of a blade cross-section 401 and a blade cross-section 402, which are extracted from (a-2) in FIGS. 5 and (b-2) in FIG. 5. (a) in FIG. 6 describes the blade cross-section 401 and (b) in FIG. 6 describes the blade cross-section 402. In the case of the blade cross-section 401, when briefly illustrated, by a cross sectional surface that is parallel to the blade cross-section 401 and nearer to the main plate 2, the blade cross-section 401 (visible outline) shifts to a blade cross-section 401-1, and then to a blade cross-section 401-2 as the cross sectional surface nears the main plate 2. That is, when one normal to the pressure surface is assumed, the normal moves in a direction of an arrow B (rotational direction) as the cross sectional surface nears the main plate 2. That is, the pressure surface (the normal to the pressure surface) is directed in the direction of the arrow B (rotational direction) as the cross sectional surface nears the main plate 2. Meanwhile, when in the case of the blade cross-section 402, since it is "angle 20*a*>angle 20*b*," the blade cross-section 402 (visible outline) shifts to a blade cross-section 402-1, and then to a blade cross-section 402-2 as the cross sectional surface nears the main plate 2. That is, as the cross sectional surface nears the main plate 2, the negative pressure surface (the normal to the negative pressure surface) is directed in a direction of an arrow C (counter-rotational direction), and the pressure surface is not directed in the rotational direction.

In the case of "angle 20*a*>angle 20*b*" in the present embodiment, the cross sectional shape changes from the shroud 3 toward the main plate 2 as shown in (b) in FIG. 6, respectively. That is, in the cross sectional surface, the cross-sectional shape broadens from the leading edge toward the trailing edge. Further, as the cross sectional surface nears the main plate 2, the visible outline on the negative pressure side in the broadened part of the cross-sectional shape shifts in the counter-rotating direction (C direction), and an area in the broadened part increases. Since the blade is in such a shape, when the cross-sectional shape changes from the blade cross-section 402 to the blade cross-section 402-2 as in (b) in FIG. 6, the negative pressure surface of the blade comes to have a warping shape in the counter-rotating direction from the leading edge toward the trailing edge as the cross-section nears the main plate 2. The warping will be specifically described. A broken line 402*d* of (b) in FIG. 6 illustrates the warping of the negative pressure surface in the blade cross-section 402, and a dashed-dotted line 402-2*d* illustrates the warping of the negative pressure surface in the blade cross-section 402-2. Although the broken line 402*d* and the dashed-dotted line 402-2*d* both here are indicated at center parts of the thickness in the cross sectional shapes to simplify an explanation, these lines describe the warpings of the negative pressure surfaces as shown above. As shown in (b) in FIG. 6, the warping is larger in the dashed-dotted line 402-2*d* which is near to the main plate 2 than the broken line 402*d*. Since air flows along the surface, in the case of (b) in FIG. 6, the relative velocity vector 21*v* of air comes to be directed in the counter-rotating direction along the warping of the negative pressure surface as the cross-section nears the main plate 2. Therefore, the resultant vector 22*v* indicating the blow-off flow 22 is made to be directed in the arrow A direction.

As shown above, when it is "angle 20*a*<angle 20*b*," the pressure surface of the blade is directed closer to the rotational direction, the relative velocity 21 in the inter-blade space is inclined to be directed in the radial direction. Then, the blow-off flow 22 (absolute velocity) is directed in the swirling direction by synthesizing the fan circumferential velocity vector and the relative velocity, and the effect is decreased.

On the other hand, when the angle 20*a* between the taper and the main plate is made large on the negative pressure surface side as in (b-1) in FIGS. 5 and (b-2) in FIG. 5 according to the present embodiment, the negative pressure surface (the normal to the negative pressure surface) in the vicinity of the trailing edge is directed in the counter-swirling direction, the relative velocity 21 comes to be directed in the counter-swirling direction. Then, since the resultant vector 22*v* indicating the blow-off flow 22 by synthesizing the relative velocity vector 21*v* and the circumferential velocity vector 23*v* is directed to the radial direction (the arrow A direction), it is possible to prevent occurrence of abnormal noise and increase in ventilation resistance in the heat-transfer fins 24 of the heat exchanger.

Since it is difficult for an airflow flowing from the shroud 3 to turn sharply from the axial direction toward the radial direction inside the fan, in the vicinity of the main plate, the air volume is the largest, and the airflow becomes a main stream in the blow-off flow. Then, there is an effect that a flow on the shroud side is also influenced by the main plate side, and is pulled in the radial direction by viscosity and diffusion. As a result, it is possible to realize an air conditioner wherein an airflow blows out in the radial direction from the whole inter-blade spaces, and wherein abnormal noise and ventilation resistance in the heat exchanger in the downstream part of the fan is decreased.

As shown above, by using the air conditioner including the centrifugal fan that includes an impeller comprised of the main plate that is driven to rotate, the shroud 3 having the intake port to take in air, and the plural blades that are connected and fixed between the main plate and the shroud 3, wherein the distance between the trailing edges of the adjacent blades is the smallest on the main plate side, and the angle between the blade surface and the main plate is larger on the negative pressure surface side than on the pressure surface side, the blow-off air velocity from the fan is directed in the radial direction of the fan; therefore, the flow direction is made to be directed along the row direction of the heat exchanger placed in the downstream part of the fan, and it is possible to realize the air conditioner that reduces occurrence of abnormal noise and ventilation resistance.

Embodiment 2.

The centrifugal fan 120 in the second embodiment will be described with reference to FIG. 7. The centrifugal fan 120 is not formed by casting of the fan, but is of an assembling type wherein the main plate 2, the shroud 3 and the blade 40 are assembled as separate parts.

Figure 7:
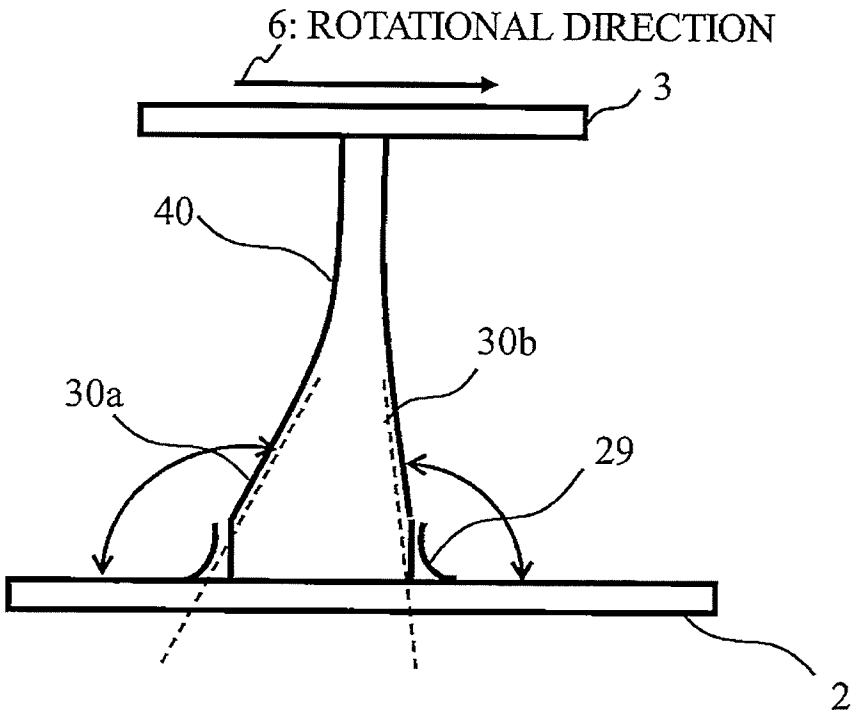
[FIG. 7] A diagram describing a centrifugal fan 120 in the second embodiment.

FIG. 7 is a diagram showing a blade trailing edge part 42 of the centrifugal fan 120 seen by a plane in a direction along the rotational axis 17 and in a direction approximately perpendicular to the blade. That is, FIG. 7 is a diagram briefly showing across sectional surface which is cut by the plane 51 of (b) in FIG. 2. When the fan is not formed by casting, but the fan is of the type wherein the main plate 2, the shroud 3 and the blade 40 are assembled as separate parts, that fan is in a form that the blade 40 is secured by a positioning guide 29 disposed on the main plate, in which case the main plate 2 and the blade 40 may intersect at an angle near 90 degrees. However, when a negative pressure surface 30*a* is more gentle than a pressure surface 30*b* in an inclined surface 30 (represented by a broken line) from the center part of the blade to the main plate 2 except for a guide mounting part, the similar effects as in the second feature of the first embodiment can be obtained.

Embodiment 3.

Figure 8:
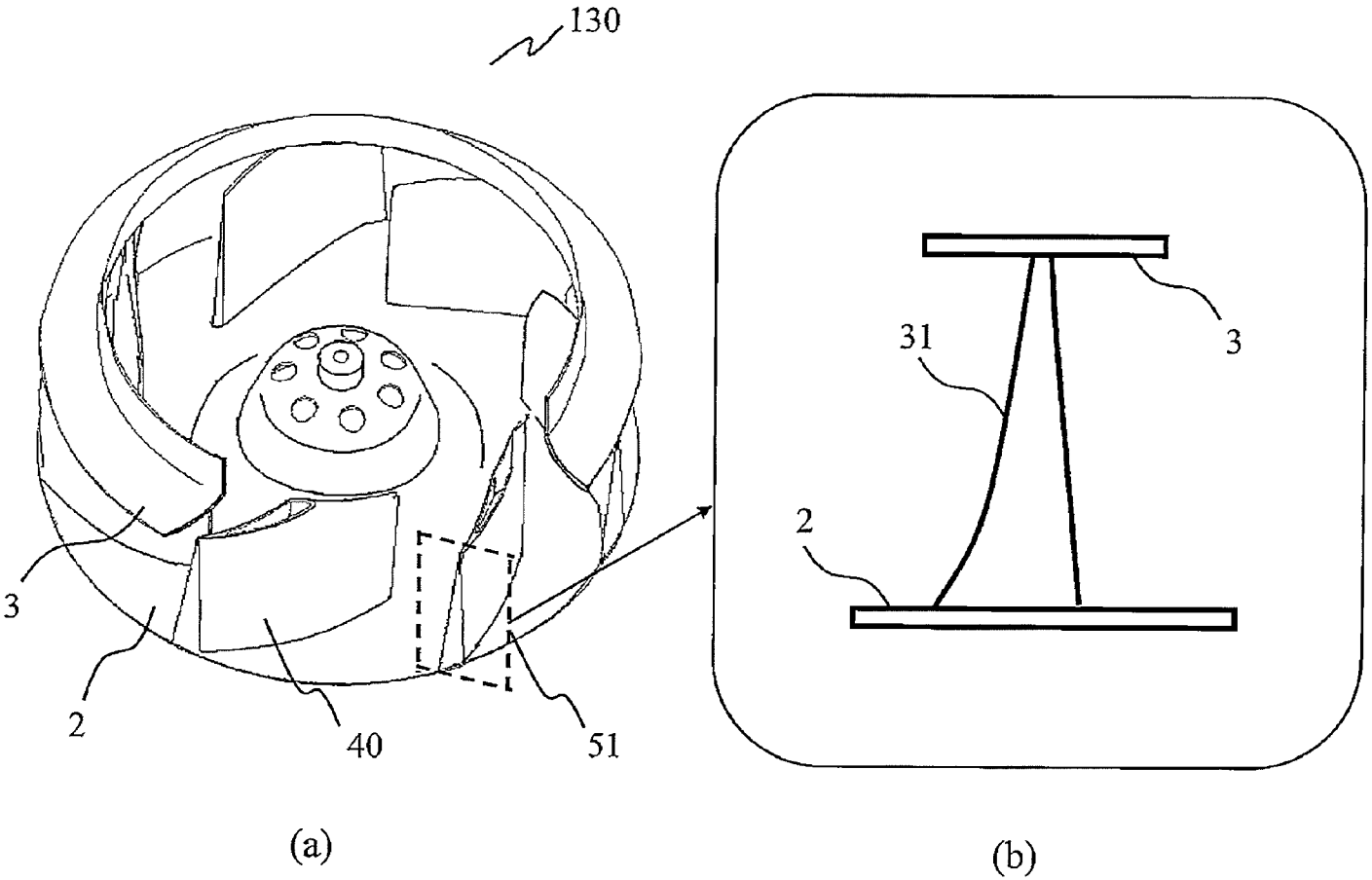
[FIG. 8] A diagram describing a centrifugal fan 130 in the third embodiment.

The centrifugal fan 130 in the third embodiment will be explained with reference to FIG. 8 and FIG. 9. FIG. 8 is a diagram approximately the same as FIG. 2. (a) in FIG. 8 shows a perspective view of the centrifugal fan 130. (b) in FIG. 8 is a diagram showing a cross sectional surface of the trailing edge of the blade 40, which is cut by the same plane 51 as in (a) in FIG. 2, and a diagram simplifying and showing a cross sectional surface wherein the trailing edge of the centrifugal fan 130 (the blade 40) in the third embodiment is cut.

In (a) in FIG. 2, the adjacent distance between the trailing edges is gradually decreased from the certain point from the shroud toward the main plate 2. Meanwhile, in (a) in FIG. 8, the adjacent distance between the trailing edges is gradually decreased toward the main plate 2 from the shroud 3, from the position of the attachment part between the shroud 3 and the trailing edge (from the beginning position in the direction from the shroud 3 toward the main plate 2).

In the centrifugal fan 130, the inter-blade space in the trailing edge is the smallest on the main plate side (the first feature), and a relation of an angle between the main plate 2 and the blade 40 (the second feature) is according to the centrifugal fan 110 in the first embodiment.

The centrifugal fan 130 is characterized in that a cross sectional shape of the trailing edge of the blade that is cut by the plane 51 shown by the broken line in the perspective view is in a taper shape 31 (taper form) which gradually broadens toward the main plate 2 from the shroud 3. That is, the centrifugal fan 130 is an embodiment that substantially defines the cross sectional shape of the trailing edge of the centrifugal fan 110 in the first embodiment.

Figure 9:
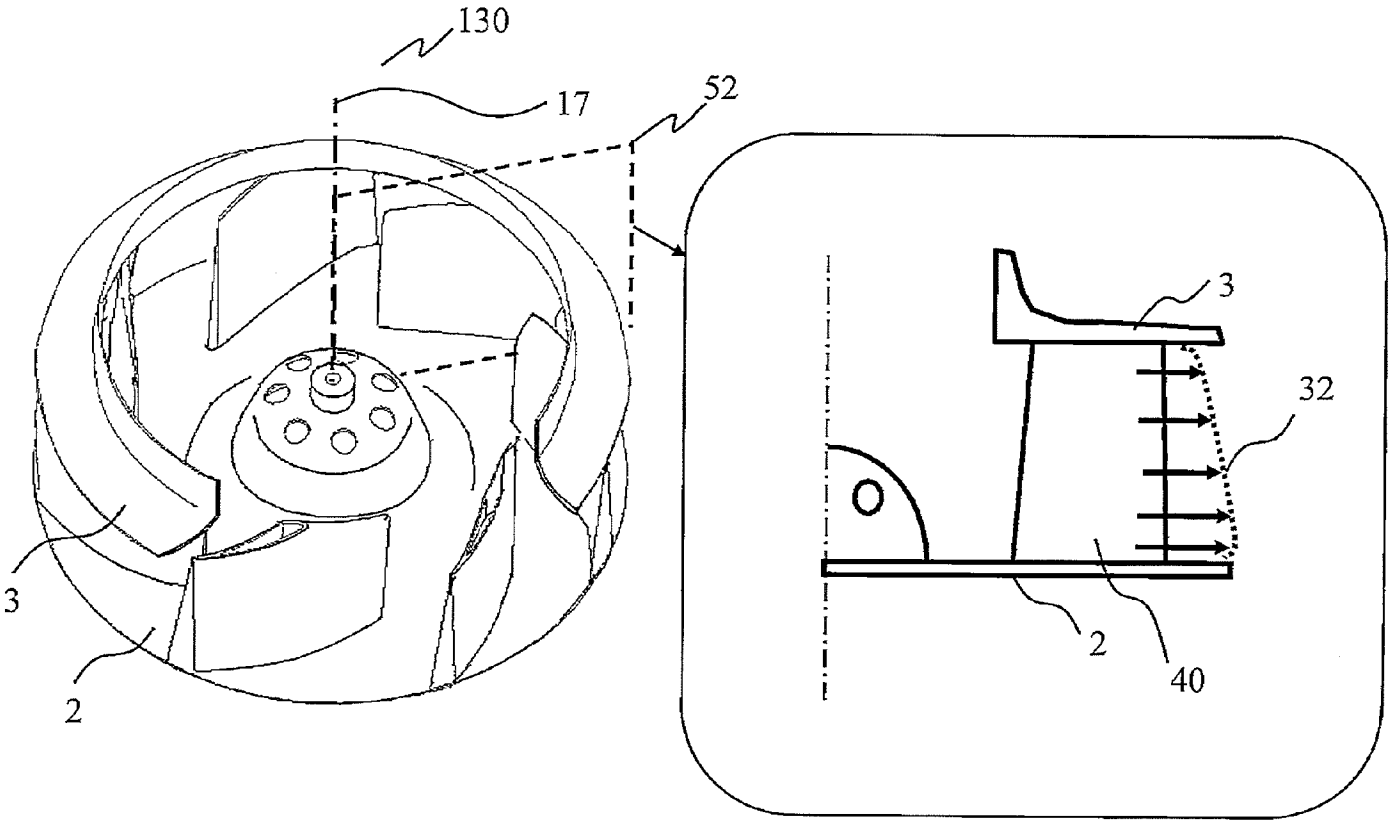
[FIG. 9] A diagram describing an effect by a taper shape 31 of a trailing edge in the centrifugal fan 130 in the third embodiment.

FIG. 9 is a diagram describing an effect by the taper shape 31. (a) in FIG. 9 is the same diagram as (a) in FIG. 8. (b) in FIG. 9 is a schematic view of a blow-off wind velocity distribution of a blade in a cross sectional surface which is cut by a plane 52 shown by a broken line in (a) in FIG. 9. The plane 52 here is in a rectangle shape whose one longitudinal side is on the rotational axis 17, and is a plane to cut the vicinity of the trailing edge of the blade 40. In the centrifugal fan 130, since a cross-sectional shape of the blade broadens in a taper shape, and a form change in the inter-blade space from the shroud side to the main plate side is smooth, the blow-off velocity distribution 32 from the main plate 2 to the shroud side in the blow outlet becomes smooth, and it is possible to reduce vortex creation by velocity difference, and to prevent energy loss.

Embodiment 4.

Figure 10:
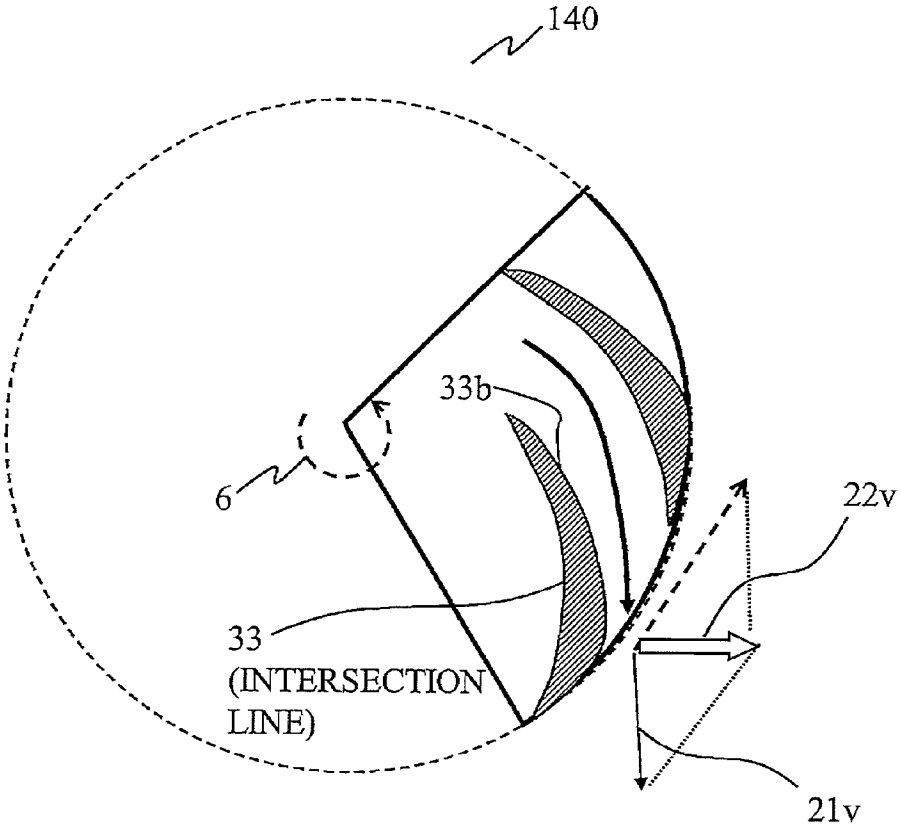
[FIG. 10] A diagram describing a centrifugal fan 140 in the fourth embodiment.

The centrifugal fan 140 in the fourth embodiment will be described with reference to FIG. 10. FIG. 10 illustrates a flow in the inter-blade space near the main plate seen by a cross sectional surface perpendicular to the rotational axis 17. That is, FIG. 10 illustrates a case wherein the blade 40 is cut at a certain point by a plane having a normal in the same direction as the rotational axis 17.

As shown in FIG. 10, the centrifugal fan 140 is characterized in that the negative pressure surface side 33 of the cross-section of the blade is concave. That is, a shape of an intersection line (corresponding to the negative pressure surface side 33) between the negative pressure surface of the blade 40 at the cross-section and a plane having the normal is in a concave shape that sags in the direction between an intersection line 33*b* of the pressure surface and the plane having the normal.

When the negative pressure surface is concave (in other words, in a convex shape hi the direction of the pressure surface at the cross-section, as described above), a relative velocity of the blade can be likely to accelerate toward the outer periphery from the inner periphery of the fan, and a direction of an airflow gradually changes from the leading edge toward the trailing edge. Therefore, it is possible to reduce loss. When the relative velocity 21 is directed in the counter-swirling direction, the blow-off flow 22 is directed in the radial direction, hence it is possible to improve an inflow into the heat exchanger.

As described above, in the centrifugal fan 140, it is possible to reduce loss that bends a flow current, and to realize reducing occurrence of abnormal noise and a flow loss.

Embodiment 5.

Figure 11:
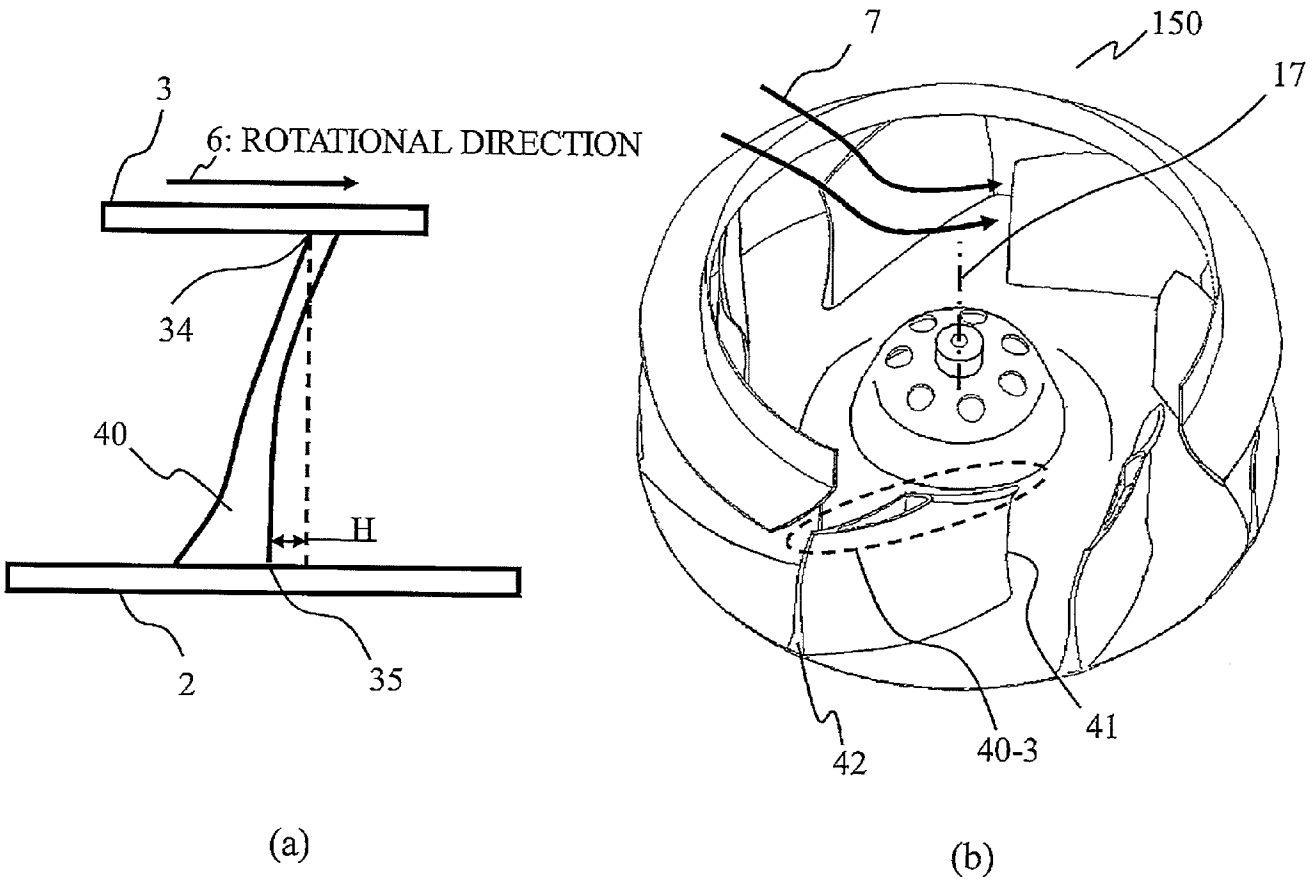
[FIG. 11] A diagram describing a centrifugal fan 150 in the fifth embodiment.

The centrifugal fan 150 in the fifth embodiment will be described with reference to FIG. 11. (a) in FIG. 11 is a diagram of the blade trailing edge part 42 of the centrifugal fan 150 seen by a cross sectional surface in a direction along the rotational axis 17 and in a direction approximately perpendicular to the blade 40. That is, (a) in FIG. 11 is a cross-sectional view that is cut by the plane 51 shown in (a) in FIG. 2. (b) in FIG. 11 is a perspective view of the centrifugal fan 150.

The inter-blade space on the main plate side is the smallest in the trailing edge (the first feature), and as for the angle between the blade and the main plate at the connecting part between the blade and the main plate (the second feature) is the same as in the embodiments as discussed above.

The centrifugal fan 150 is characterized in that, as shown in (a) in FIG. 11, regarding the attaching position of the trailing edge of the blade, a connecting part 34 of the negative pressure surface on the shroud side (the connecting part between the shroud 3 and the blade 40) is placed closer to the rotational direction than a connecting part 35 of the pressure surface on the main plate side (the connecting part between the main plate 2 and the blade 40). That is, as shown in (a) in FIG. 11, on the shroud side and on the main plate side of the trailing edge of the blade, the connecting part 34 (the shroud negative pressure surface side) is displaced by a size H in the rotational direction from the connecting part 35 (the main plate pressure surface side).

In the first through fourth embodiments as mentioned above, there is fear that an air volume on the main plate side is decreased since the inter-blade space on the main plate side is small. The fifth embodiment is an embodiment wherein noise in the unit is reduced without decreasing an air volume of the entire fan. Since the blow outlet on the shroud side is near to the fan intake port 39 of the shroud 3, and is in the direction approximately at a right angle, the flow current 7 is less likely to turn and a passing air volume is likely to be small. Therefore, by making a shroud side 40-3 of the blade 40 tilt in the rotational direction to have a shape which allows an airflow to smoothly pass from the intake port 39 toward the shroud side of the blow outlet, the air volume is increased. As a result, it is possible to realize an air conditioner wherein the blow-off absolute velocity is easily directed in the radial direction of the fan without decreasing the air volume.

Embodiment 6.

Figure 12:
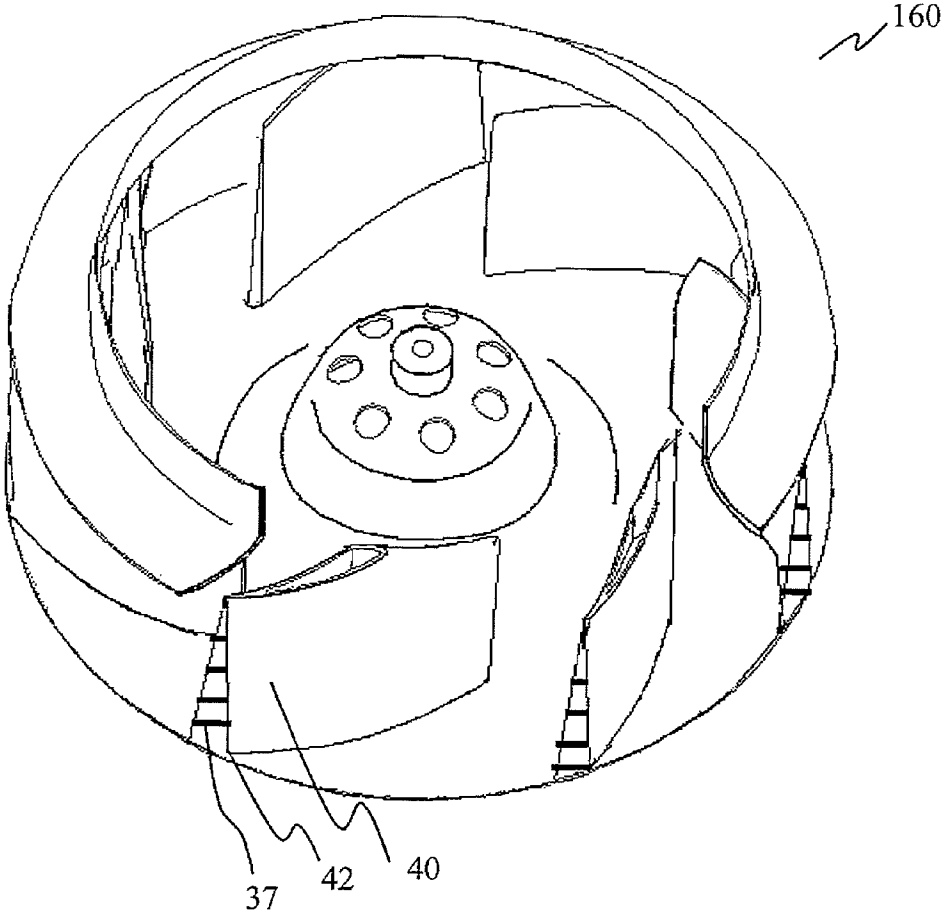
[FIG. 12] A diagram describing a centrifugal fan 160 in the sixth embodiment.

FIG. 12 shows a perspective view of the centrifugal fan 160 in the sixth embodiment. The centrifugal fan 160 has a structure wherein a wake reduction part 37 such as a protrusion, a groove, etc. for reducing wake flow is formed on the surface of the end surface of the blade trailing edge part 42 in the blade 40 of the fan described in the above-mentioned embodiments. Since the width of the trailing edge is broad, a wake flow area of slow velocity is generated immediately behind the trailing edge part where the flows from the pressure surface and the negative pressure surface converge. Then, the velocity gradient is increased, and there is a concern that turbulent noise is increased. Thus, the wake reduction part such as the protrusion, the groove, etc. for forcibly spreading the flows from the pressure surface and the negative pressure surface and reducing the velocity gradient is formed in the end part of the trailing edge. By the wake reduction part, it is possible to reduce wake flow and turbulent noise.

Embodiment 7.

The centrifugal fan 110 through the centrifugal fan 160 as described above have the structures wherein the trailing edges are shaped to have large thicknesses for decreasing the inter-blade space on the main plate side in order to increase the velocity between the blades. When the thickness of the trailing edge is made large, a burden on the motor is increased due to increase in weight, and the efficiency is lowered. Thus, by making the inside of the trailing edge whose thickness is large to have a hollow structure, the fan is reduced in weight, and it is possible to realize an air conditioner that offers noise reduction and high efficiency.

Reference Signs List

1 Centrifugal fan, 2 Main plate, 3 Shroud, 4 Blade, 5 Hollow structure, 6 Fan rotational direction, 7 Airflow, 8 Top plate, 9 Side plate, 10 Motor, 11 Heat exchanger, 12 Facing plate, 13 Intake port, 14 Blow outlet, 15 Vane, 16 Airflow passing through an air conditioner, 17 Rotational axis, 18 Arc length, 19 Blade surface, 20 Angle between the main plate and the blade surface, 21 Flow seen from a rotating blade (relative velocity), 22 Blow-off flow (absolute velocity), 23 Fan circumferential velocity vector, 24 Heat-transfer fm, 25 Row direction of the heat exchanger, 26 Area where the fan is the closest to the heat exchanger, 27 Leading edge of the heat-transfer fin, 28 Vortex, 29 Positioning guide, 30 Inclined surface, 31 Taper shape, 32 Blow-off velocity distribution, 33 Negative pressure surface side of the blade cross-section perpendicular to the axis, 34 Connecting part of the negative pressure surface on the shroud side, 35 Connecting part of the pressure surface on the main plate side, 36 Blade on the shroud side, 37 Wake reducing part, 39 Intake port, 40 Blade, 41 Blade leading edge part, 42 Blade trailing edge part, 53*a* and 53*b* Extending inclination, 110, 120, 130, 140, 150 and 160 Centrifugal fan.

The invention claimed is:

1. A centrifugal fan comprising:

a main plate that is driven to rotate around a rotational axis;

a shroud that is disposed so as to be opposed to the main plate, including an intake port to take in air; and a plurality of blades that are disposed upright between the main plate and the shroud, wherein in two adjacent blades among the plurality of blades, an adjacent distance between trailing edges is gradually decreased in a direction from the shroud to the main plate, from a point on each of the two adjacent blades to the main plate, and the adjacent distance between trailing edges is constant from the shroud to the point on each of the two adjacent blades in the direction from the shroud to the main plate, wherein the cross-sectional width of each blade in between a negative pressure surface side of the blade and a pressure surface side of the blade increases from a leading edge of the blade towards the trailing edge of each blade, and at the trailing edge of each blade, the pressure surface side flares out in the rotational direction of the centrifugal fan near the main plate and the negative pressure surface side flares out in the direction opposite to the rotational direction of the centrifugal fan near the main plate, and wherein in each blade of the plurality of blades, an angle between the negative pressure surface side of each blade and the main plate at a joint between the main plate and the negative pressure surface side is larger than an angle between the pressure surface side of each blade and the main plate at a joint between the main plate and the pressure surface side.

2. The centrifugal fan as defined in claim 1, wherein when each blade is cut by a plane having a normal in an approximately same direction as a direction perpendicular to the rotational axis, and as a direction from a trailing edge of each blade toward the leading edge of each blade as viewed from a direction of the rotational axis on a side of the shroud, a cross sectional shape of the trailing edge is in a taper shape that gradually broadens in the direction from the shroud toward the main plate.

3. The centrifugal fan as defined in claim 1, wherein when each blade is cut by a plane having a normal in a same direction as the rotational axis, a shape of an intersection line of the negative pressure surface and the plane is a concave shape that sags in a direction of an intersection line of the pressure surface and the plane.

4. The centrifugal fan as defined in claim 1, wherein in each blade, a connecting part between the shroud and the negative pressure surface on a side of the shroud is located closer to the rotational direction than a connecting part between the main plate and the pressure surface on a side of the main plate.

5. The centrifugal fan as defined in claim 1, wherein in each blade, an inside of the trailing edge is formed to have a hollow structure.

6. An air conditioner including the centrifugal fan as defined in claim 1.

7. The centrifugal fan as defined in claim 1, wherein the distance between the negative pressure surface side and the pressure surface side of each blade increases in size for over more than half of the vertical distance between the shroud and the main plate.

* * * * *